US007556240B1

(12) United States Patent
Bauer et al.

(10) Patent No.: US 7,556,240 B1
(45) Date of Patent: Jul. 7, 2009

(54) RIG DRAWWORKS

(75) Inventors: Timothy W. Bauer, Kenmare, ND (US); David D. Zeltinger, Glenburn, ND (US)

(73) Assignee: MW Industries, Inc., Kenware, ND (US)

( * ) Notice: Subject to any disclaimer, the term of this patent is extended or adjusted under 35 U.S.C. 154(b) by 0 days.

(21) Appl. No.: 11/621,332

(22) Filed: Jan. 9, 2007

Related U.S. Application Data

(60) Provisional application No. 60/825,796, filed on Sep. 15, 2006.

(51) Int. Cl.
*B66D 1/14* (2006.01)

(52) U.S. Cl. ..... 254/294; 254/358; 254/365

(58) Field of Classification Search ..... 254/294, 254/311, 317, 358, 365
See application file for complete search history.

(56) References Cited

U.S. PATENT DOCUMENTS 3,752,442 A * 8/1973 Coombs ..... 254/293
3,917,230 A * 11/1975 Barron ..... 254/270
4,070,981 A * 1/1978 Guinn et al. ..... 114/293
4,488,708 A * 12/1984 Frye ..... 254/355

* cited by examiner

*Primary Examiner*—Emmanuel M Marcelo
(74) *Attorney, Agent, or Firm*—Marsh Fischmann & Breyfogle LLP

(57) ABSTRACT

A drawworks for a rig is disclosed. This drawworks may be used by any appropriate type of rig, such as a drilling rig or a service/workover rig. The drawworks includes at least one drum (e.g., a main drum, a sand drum), and each such drum may incorporate a number of desirable features. For instance, the drum may include a lubricant flowpath with at least one annular section that reduces the potential for clogging. This drum may also include a drive hub that is detachably interconnected with one or more drive sprockets so as to facilitate repair/replacement. Finally, this drum may include one or more structures for reducing the potential that certain lubricant will reach the clutch, where this lubricant is propelled from one or more rotating drive sprockets and/or the associated chain.

50 Claims, 8 Drawing Sheets

RIG DRAWWORKS

CROSS-REFERENCE TO RELATED APPLICATIONS

This patent application claims priority under 35 U.S.C. §119(e) to pending U.S. patent Provisional Patent Application Ser. No. 60/825,796, that is entitled "RIG DRAWWORKS," that was filed on Sep. 15, 2006, and entire disclosure of which is hereby incorporated by reference in its entirety herein.

FIELD OF THE INVENTION

The present invention generally relates to rigs such as drilling or service/workover rigs and, more particularly, to a drawworks used by such rigs.

BACKGROUND OF THE INVENTION

Two general categories of rigs include drilling rigs and service/workover rigs. Drilling rigs are used to drill wells (e.g., oil, natural gas), while service/workover rigs are used to service or work existing wells for any appropriate reason. Representative servicing or workovers of existing wells includes without limitation replacing one or more components (including downhole components) associated with the well (e.g., tubing, valves, seals, flanges, blowout preventers), directing one or more components into the well for any appropriate purpose (e.g., a tool for opening a downhole blockage), executing one or more well operations (e.g., fracturing, acidizing), or the like.

Both drilling and service/workover rigs typically use a derrick that supports one or more pulleys, one or more block and tackles, or the like. Various lines, cable, or the like may be directed around one or more of these pulleys/block and tackles to lift the desired component(s) and/or to lower the desired component(s) as desired/required. These lines or cables are anchored to what is commonly referred to in the art as a drawworks. An appropriate power source (e.g., a right angle drive) rotates one or more drums of the drawworks in one direction to wind the line/cable around one or more drums of the drawworks to lift the desired component(s), while the power source rotates one or more drums of the drawworks in the opposite direction to unwind the line/cable from one or more drums of the drawworks to lower the desired component(s). "Cable" is commonly viewed as being of a heavier grade than "line," and thereby more appropriate for handling heavier components. Cable is commonly associated with a main drum of a drawworks, while line is commonly associated with a sand drum of a drawworks. Service or workover rigs use a drawworks having both a main drum and a sand drum, while drilling rigs typically only use a main drum.

There are various deficiencies with at least certain existing drawworks designs. One is lubrication. Regular lubrication is of course required to maintain various components of the drawworks in proper working order, including various bearings. One known drawworks uses a plurality of individual slots that are spaced about the perimeter of a shaft on which the noted cable/line is wound, and further that extend along at least a portion of the length of this shaft. Lubricant that is directed into an individual slot travels along the slot and to one or more bearings. The volume of each individual slot is relatively small in that the depth of each individual slot on the exterior of the shaft is relatively shallow. Therefore, the individual slots are prone to becoming block, for instance due to "waxing" or solidification of lubricant within the slot.

At least certain drawworks designs are somewhat problematic in relation to maintenance. The main drum and the sand drum are of a different size in the case of all known drawworks. Therefore, many of their parts are not interchangeable, such as the drive sprockets that rotate the shaft to wind or unwind the cable or line. Moreover, one or more components of at least some drawworks are permanently joined together to define an assembly. This is potentially deficient in a number of respects. One is that the entire assembly may need to be removed to access/replace one or more components. This entire assembly also may be quite heavy and difficult to handle. Another is that if one of the components of the assembly breaks or becomes unsuitably worn, the entire assembly may very well need to be replaced. In this regard, it is common for at least some drawworks to use a pair of drive sprockets that are welded together to define a drive sprocket assembly, where each individual drive sprocket has a set of gear teeth about its perimeter, and further to weld this drive sprocket assembly to a common drive hub. The sand drum of at least some drawworks have a drive sprocket assembly as described welded to each side of a common drive hub, such that the pair of drive sprocket assemblies sandwiches a flange of the drive hub between the pair of drive sprocket assemblies.

SUMMARY OF THE INVENTION

A first aspect of the present invention is embodied by a rig drawworks that includes a first drum. This first drum in turn includes a first drum shaft, first and second drum heads, a drive hub, a first drive hub bearing, and a lubricant flowpath. The first drum shaft is capable of rotating about a rotational axis that extends in a longitudinal dimension. The first and second drum heads are spaced along this first drum shaft to accommodate the wrapping of a rig line about the first drum shaft between the first and second drum heads. The drive hub is disposed about, is rotatable relative to, and is selectively rotatable with the first drum shaft, with the first drive hub bearing being disposed between the drive hub and the first drum shaft. The lubricant flowpath includes this first drive hub bearing (e.g., lubricant may flow through the first drive hub bearing), as well as a first lubricant flowpath section that is annular and that is disposed about the first drum shaft.

Various refinements exist of the features noted in relation to the first aspect of the present invention. Further features may also be incorporated in the first aspect of the present invention as well. These refinements and additional features may exist individually or in any combination. The drawworks may be used with any type of rig, including without limitation a drilling rig and a service or workover rig (hereafter a workover rig). The first drum of the drawworks may be in the form of a main drum in the case of both a drilling rig and a workover rig, where the rig line that may be wrapped about the first drum shaft would typically be in the form of cable for handling (e.g., lifting, supporting, lowering) a heavier component(s). The first drum of the drawworks may also be in the form of a sand drum in the case of a workover rig, where the rig line that may be wrapped about the first drum shaft would typically be in the form of a wire line or the like for handling (e.g., lifting, supporting, lowering) a lighter component(s). As such, the "rig line" referred to in relation to the first aspect may be of any appropriate size, shape, configuration, and/or type (e.g., generally, a wrappable, elongate member).

The individual components of the drawworks may be of any appropriate size, shape, and/or configuration, for instance to accommodate the anticipated load to which they will be exposed during operation. Other components may be used by the drawworks as well. For instance, the first drum may include a brake for terminating rotation of the first drum shaft. The first drum may also include a clutch for selectively rotating the first drum shaft. The drawworks may also include both a main drum and a sand drum (e.g., an appropriate drive may rotate the sand drum, and the rotation of the sand drum may be used to rotate the main drum), and a separate first drum may be used by each of the main drum and the sand drum. In one embodiment, at least certain components of the first drum (e.g., drive hub, drive sprockets, seals, bearings) may be used in both the main drum and sand drum (e.g., these parts are interchangeable between the main drum and sand drum in this embodiment).

The first drive hub bearing may be of any appropriate size, shape, configuration, and/or type, such as a ball bearing. A second drive hub bearing could also be utilized, could be disposed in end-to-end or back-to-back relation to the first drive hub bearing (e.g., a double ball bearing configuration), and may also define part of the lubricant flowpath. The first drive hub bearing may be located downstream of the annular, first lubricant flowpath section, where "downstream" refers to the general direction of a flow of an appropriate lubricant through the lubricant flowpath while lubricating at least the first drive hub bearing (e.g., lubricant will flow through the annular, first lubricant flowpath section prior to reaching the first drive hub bearing). Another way to characterize the position of the first drive hub bearing relative to the annular, first lubricant flowpath section is that the first drive hub bearing may be positioned closer to the adjacentmost free end of the first drum shaft than the annular, first lubricant flowpath section. Yet another way to characterize the position of the first drive hub bearing is that the annular, first lubricant flowpath section may be located between the first drive hub bearing and an inlet associated with the lubricant flowpath.

The first drum of the drawworks may also include a first bearing that is disposed about the first drum shaft and that is of any appropriate size, shape, configuration, and/or type. The first bearing may be disposed within a bearing housing that is spaced from the drive hub along the first drum shaft, and the first bearing may also be part of the lubricant flowpath (e.g., lubricant may flow through the first bearing). In one embodiment, the first bearing is in the form of a self-aligning bearing. Multiple self-aligning bearings could also be utilized, for instance a pair of self-aligning bearings may be disposed in end-to-end or back-to-back relation. In any case, the first bearing may be located upstream of the annular, first lubricant flowpath section, where "upstream" refers to the opposite direction of a general flow of a lubricant through the lubricant flowpath while lubricating at least the first bearing and first drive hub bearing (e.g., lubricant will flow through the first bearing prior to reaching the annular, first lubricant flowpath section), the first bearing may be located upstream of the first drive hub bearing (e.g., lubricant will flow through the first bearing prior to reaching the first drive hub bearing), or both. Another way to characterize the position of the first bearing relative to the annular, first lubricant flowpath section is that the annular, first lubricant flowpath section may be positioned closer to the adjacentmost free end of the first drum shaft than the first bearing. Yet another way to characterize the position of the first bearing is that the annular, first lubricant flowpath section may be located between the first bearing and the first drive hub bearing, that the first bearing may be located between an inlet associated with the lubricant flowpath and the annular, first lubricant flowpath section, or both.

The above-noted inlet which may be associated with the lubricant flowpath may be in the form of a port that is disposed on an exterior surface of the above-noted bearing housing. This port may be interconnected with a common lubricant manifold that allows multiple components to be simultaneously lubricated from a single zirc or the like. In any case, at least part of the lubricant flowpath may extend from this port, through the bearing housing, and then through the first bearing. In accordance of the foregoing, the lubricant flowpath could further extend from the first bearing, to the annular, first lubricant flowpath section, and then to the first drive hub bearing. The lubricant flowpath may terminate in an annular lubricant cavity that is disposed somewhere downstream of the first drive hub bearing (e.g., immediately downstream of the first drive hub bearing) in relation to a flow of lubricant through the lubricant flowpath during a lubrication of at least the first drive hub bearing. One or more annular seals may be disposed downstream of the annular lubricant cavity (e.g., such that the lubricant cavity is located somewhere between the first drive hub bearing and this annular seal(s) in the longitudinal dimension).

The drive hub may include an annular first drive hub section. The first drum may further include a sleeve that is disposed about the first drum shaft and that is disposed radially inwardly from this first drive hub section (e.g., such that the sleeve is disposed between the first drum shaft and the annular first drive hub section in a dimension that is perpendicular to the rotational axis of the first drum shaft). In one embodiment, the annular, first lubricant flowpath section is located between this sleeve and the first drive hub section.

The drive hub may further include an annular second drive hub section that is disposed radially outwardly from the first drive hub bearing. This annular second drive hub section may be further characterized as being located further from the first drum shaft than the above-noted first drive hub section.

The first drum of the drawworks may also further include first and second drive sprockets. The drive hub may further include a drive hub flange that is sandwiched between the first and second drive sprockets. The second drive sprocket may be located between the drive hub flange and the above-noted annular first drive hub section in the longitudinal dimension.

The above-noted drive hub flange may be detachably interconnected with each of the first drive sprocket and the second drive sprocket (e.g., such that each such part may be separately replaced/refurbished). Each of the first and second drive sprockets may include a first gear teeth set that is disposed about the first drum shaft, and a second gear teeth set that is also disposed about the first drum shaft, but spaced from the first gear teeth set along the first drum shaft. In one embodiment, both the first drive sprocket and the second drive sprocket are integral structures (e.g., of one-piece construction, or such that there are no joints between any adjacent regions of either the first drive sprocket or the second drive sprocket).

The first drum of the drawworks may further include an oil slinger that is interconnected with at least the first drive sprocket. This oil slinger may include an oil slinging section that extends at least generally radially outwardly relative to the first drum shaft to a location in the above-noted radial dimension that is beyond a location of the perimeter of the first drive sprocket (as well as any second drive sprocket) in the radial dimension. In one embodiment, this oil slinging section is disposed perpendicularly to the rotational axis of the first drum shaft. Other orientations may be appropriate. In another embodiment, the first drive sprocket is located between the noted drive hub flange (the portion of the drive hub that is mounted to or interfaces with the first drive sprocket, or that which is sandwiched between the first and second drive sprockets) and the oil slinging section in the longitudinal dimension (e.g., the first drive sprocket being disposed closer to the adjacentmost free end of the first drum shaft than the drive hub flange). The drive hub flange, the first drive sprocket (as well as any second drive sprocket), and the oil slinger may be detachably interconnected to define a common assembly.

Lubricant may of course be applied to the above-noted first drive sprocket (as well as any second drive sprocket), as well as any corresponding chain. The first drive sprocket may always rotate during operation of the drawworks. In any case, some of this lubricant will have a tendency to be propelled away from the first drive sprocket and/or its corresponding chain. The above-noted oil slinger provides a surface for contacting this lubricant, and thereafter redirecting this lubricant radially away from the first drum shaft, for instance so as to reduce the potential for this lubricant coming into contact with the above-noted clutch. A clutch cover may be interconnected (e.g., detachably) and rotate with the oil slinger as well.

The first drum of the drawworks may include any appropriate number of drive sprockets disposed about the first drum shaft. Consider the case where the first drum of the drawworks includes at least a first drive sprocket. One characterization is that the above-noted drive hub is located between the first drive sprocket and the above-noted first drive hub section (e.g., that portion of the drive hub that defines at least one boundary of the annular, first lubricant flowpath section) in the longitudinal dimension. Another characterization is that the above-noted drive hub flange is located between the first drive sprocket and the annular first lubricant flowpath section in the longitudinal dimension. In accordance with the foregoing, both individually or in any combination: 1) the drive hub flange may be detachably interconnected with the first drive sprocket; 2) the first drive sprocket may include first and second gear teeth sets that are spaced in the longitudinal dimension, and may be an integral structure; and/or 3) an oil slinger may be interconnected with at least the first drive sprocket.

A second aspect of the present invention is embodied by a rig drawworks that includes a first drum. This first drum in turn includes a first drum shaft, first and second drum heads, a drive hub, and a first drive sprocket. The drive shaft is capable of rotating about a rotational axis that extends in a longitudinal dimension. The first and second drum heads are spaced along this first drum shaft to accommodate the wrapping of a rig line about the first drum shaft between the first and second drum heads. The drive hub is disposed about, is rotatable relative to, and is selectively rotatable with the first drum shaft. Furthermore, the first drive sprocket and the drive hub are detachably interconnected so as to collectively rotate.

Various refinements exist of the features noted in relation to the second aspect of the present invention. Further features may also be incorporated in the second aspect of the present invention as well. These refinements and additional features may exist individually or in any combination. Initially, the various features discussed above in relation to the first aspect may be used by this second aspect, individually or in any combination, including without limitation those relating to the above-noted lubricant flowpath. Moreover, the drawworks may be used with any type of rig, including without limitation a drilling rig and a service or workover rig (hereafter a workover rig). The first drum of the drawworks may be in the form of a main drum in the case of both a drilling rig and a workover rig, where the rig line that may be wrapped about the first drum shaft would typically be in the form of cable for handling (e.g., lifting, supporting, lowering) a heavier component(s). The first drum of the drawworks may also be in the form of a sand drum in the case of a workover rig, where the rig line that may be wrapped about the first drum shaft would typically be in the form of a wire line or the like for handling (e.g., lifting, supporting, lowering) a lighter component(s). As such, the "rig line" referred to in relation to the second aspect may be of any appropriate size, shape, configuration, and/or type (e.g., generally, a wrappable, elongate member).

The individual components of the drawworks may be of any appropriate size, shape, and/or configuration, for instance to accommodate the anticipated load to which they will be exposed during operation. Other components may be used by the drawworks as well. For instance, the first drum may include a brake for terminating rotation of the first drum shaft. The first drum may also include a clutch for selectively rotating the first drum shaft. The drawworks may also include both a main drum and a sand drum (e.g., an appropriate drive may rotate the sand drum, and the rotation of the sand drum may be used to rotate the main drum), and a separate first drum may be used by each of the main drum and the sand drum. In one embodiment, at least certain components of the first drum (e.g., drive hub, drive sprockets, seals, bearings) may be used in both the main drum and sand drum (e.g., these parts are interchangeable between the main drum and sand drum in this embodiment).

The first drum of the drawworks may further include a second drive sprocket. The drive hub may further include a drive hub flange that is sandwiched between the first and second drive sprockets. This drive hub flange may be detachably interconnected with each of the first drive sprocket and the second drive sprocket (e.g., such that each such part may be separately replaced/refurbished). At least one of, and more preferably each of, the first and second drive sprockets may include a first gear teeth set that is disposed about the first drum shaft, and a second gear teeth set that is also disposed about the first drum shaft, but spaced from the first gear teeth set along the first drum shaft. In one embodiment, the first drive sprocket and any second drive sprocket are each integral structures (e.g., of one-piece construction, or such that there are no joints between any adjacent regions of either the first drive sprocket or any second drive sprocket).

The first drum of the drawworks may further include an oil slinger that is interconnected with at least the first drive sprocket. This oil slinger may include an oil slinging section that extends at least generally radially outwardly relative to the first drum shaft to a location in the above-noted radial dimension that is beyond a location of the perimeter of the first drive sprocket in the radial dimension. In one embodiment, this oil slinging section is disposed perpendicularly to the rotational axis of the first drum shaft. Other orientations may be appropriate. In another embodiment, the first drive sprocket is located between a drive hub flange (a portion of the drive hub that is mounted to or interfaces with the first drive sprocket) and the oil slinging section in the longitudinal dimension (e.g., the oil slinging section being disposed closer to the adjacentmost free end of the first drum shaft than the first drive sprocket). The oil slinger may be detachably interconnected with at least the first drive sprocket.

Lubricant may of course be applied to the first drive sprocket and/or its corresponding chain (as well as to any second drive sprocket and/or its corresponding chain). This first drive sprocket may always rotate during operation of the drawworks. In any case, some of this lubricant will have a tendency to be propelled away from the first drive sprocket and/or its corresponding chain. The above-noted oil slinger provides a surface for contacting this lubricant, and thereafter redirecting this lubricant radially away from the first drum shaft, for instance so as to reduce the potential for this lubricant coming into contact with the above-noted clutch. A clutch cover may be interconnected (e.g., detachably) and rotate with the oil slinger as well.

A third aspect of the present invention is embodied by a rig drawworks that includes a first drum. This first drum in turn includes a first drum shaft, first and second drum heads, a first drive sprocket, and an oil slinger. The drive shaft is capable of rotating about a rotational axis that extends in a longitudinal dimension. The first and second drum heads are spaced along this first drum shaft to accommodate the wrapping of a rig line about the first drum shaft between the first and second drum heads. The first drive sprocket is disposed about, is rotatable relative to, and is selectively rotatable with the first drum shaft. Furthermore, the first drive sprocket and the oil slinger are appropriately interconnected so as to collectively rotate.

Various refinements exist of the features noted in relation to the third aspect of the present invention. Further features may also be incorporated in the third aspect of the present invention as well. These refinements and additional features may exist individually or in any combination. Initially, the various features discussed above in relation to the first aspect may be used by this third aspect, individually or in any combination, including without limitation those relating to the above-noted lubricant flowpath. Moreover, the drawworks may be used with any type of rig, including without limitation a drilling rig and a service or workover rig (hereafter a workover rig). The first drum of the drawworks may be in the form of a main drum in the case of both a drilling rig and a workover rig, where the rig line that may be wrapped about the first drum shaft would typically be in the form of cable for handling (e.g., lifting, supporting, lowering) a heavier component(s). The first drum of the drawworks may also be in the form of a sand drum in the case of a workover rig, where the rig line that may be wrapped about the first drum shaft would typically be in the form of a wire line or the like for handling (e.g., lifting, supporting, lowering) a lighter component(s). As such, the "rig line" referred to in relation to the third aspect may be of any appropriate size, shape, configuration, and/or type (e.g., generally, a wrappable, elongate member).

The individual components of the drawworks may be of any appropriate size, shape, and/or configuration, for instance to accommodate the anticipated load to which they will be exposed during operation. Other components may be used by the drawworks as well. For instance, the first drum may include a brake for terminating rotation of the first drum shaft. The first drum may also include a clutch for selectively rotating the first drum shaft. The drawworks may also include both a main drum and a sand drum (e.g., an appropriate drive may rotate the sand drum, and the rotation of the sand drum may be used to rotate the main drum), and a separate first drum may be used by each of the main drum and the sand drum. In one embodiment, at least certain components of the first drum (e.g., drive hub, drive sprockets, seals, bearings) may be used in both the main drum and sand drum (e.g., these parts are interchangeable between the main drum and sand drum in this embodiment).

The first drum of the drawworks may further include a drive hub that is disposed about, rotatable relative to, and selectively rotatable with the first drum shaft, and further that is interconnected with the first drive sprocket. The first drum may further include a second drive sprocket, and the noted drive hub may further include a drive hub flange that is sandwiched between the first and second drive sprockets. At least one of, and more preferably each of, the first and second drive sprockets may include a first gear teeth set that is disposed about the first drum shaft, and a second gear teeth set that is also disposed about the first drum shaft, but spaced from the first gear teeth set along the first drum shaft. In one embodiment, both the first drive sprocket and the second drive sprocket are integral structures (e.g., of one-piece construction, or such that there are no joints between any adjacent regions of either the first drive sprocket or the second drive sprocket). In another embodiment, the drive hub, first drive sprocket, and any second drive sprocket are detachably interconnected so as to collectively rotate (e.g., such that each such part may be separately replaced/refurbished).

Lubricant may of course be applied to the first drive sprocket and its corresponding chain (as well as to any second drive sprocket and its corresponding chain). This first drive sprocket may always rotate during operation of the drawworks. In any case, some of this lubricant will have a tendency to be propelled away from the first drive sprocket and/or its corresponding chain. The above-noted oil slinger provides a surface for contacting this lubricant, and thereafter redirecting this lubricant radially away from the first drum shaft, for instance so as to reduce the potential for this lubricant coming into contact with the above-noted clutch. A clutch cover may be interconnected (e.g., detachably) and rotate with the oil slinger as well.

DETAILED DESCRIPTION

Figure 1:
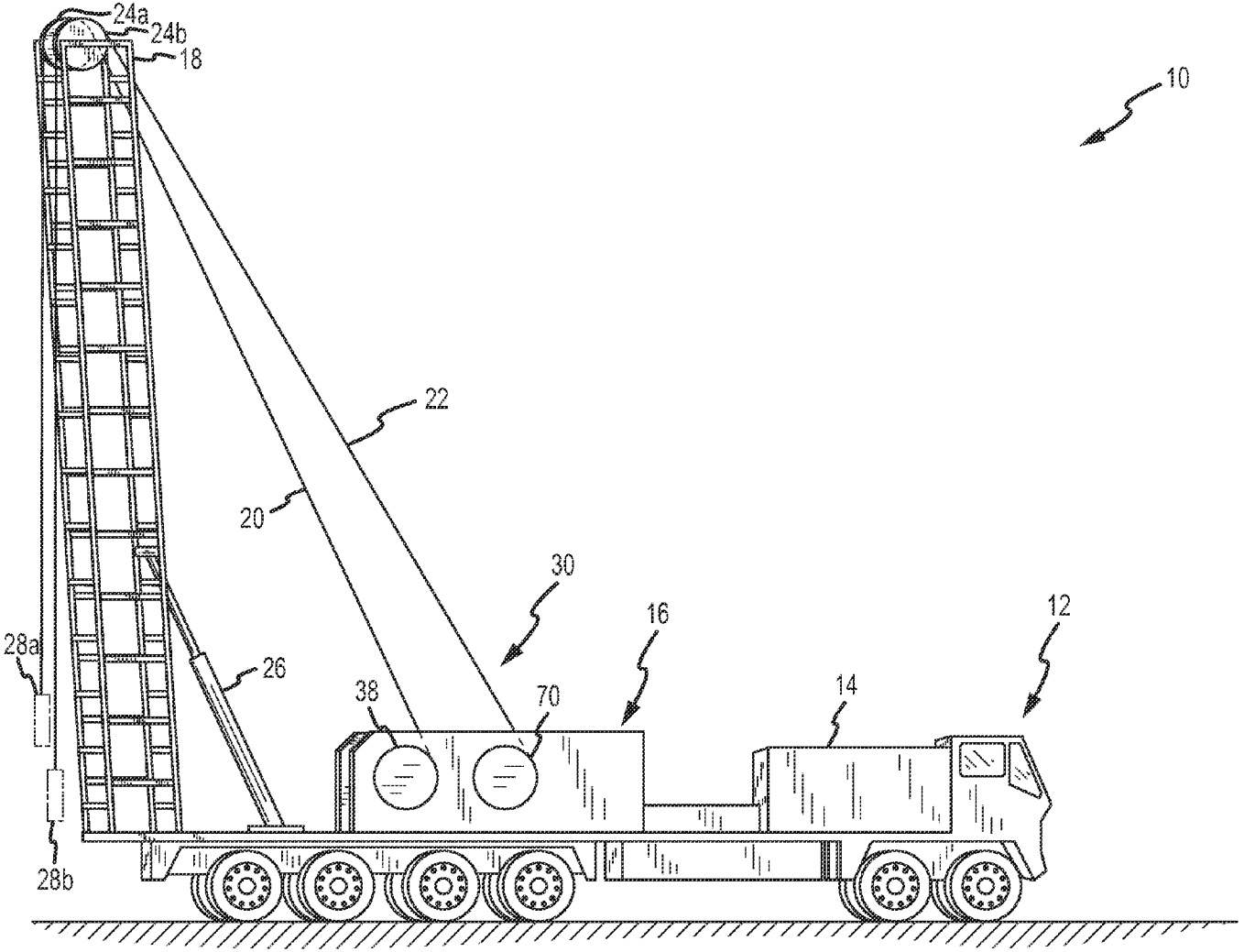
FIG. 1 is a perspective view of one embodiment of a service or workover rig.

FIG. 1 schematically illustrates one embodiment of a service or workover rig 10. The workover rig 10 is incorporated on an appropriate vehicle 12 on which a collapsible derrick 18 is mounted. The derrick 18 may be of any appropriate size, shape, and/or configuration. A derrick lift 26 of any appropriate size, shape, configuration, and/or type (e.g., one or more hydraulic cylinders) may be used to both raise the derrick 18 to the position illustrated in FIG. 1, and to lower the derrick 18 back into a transport position on the vehicle 12 (not shown, but where the derrick 18 is in an at least generally prone position).

The workover rig 10 further includes a drawworks 30 having both a main drum 38 and a sand drum 70. A cable 20 is typically associated with the main drum 38, while a wire line 22 is typically associated with the sand drum 70 (e.g., the cable 20 generally being more robust or stronger than the wire line 22, and thereby accommodating a higher load). Each of the cable 20 and wire line 22 may be of any appropriate size, shape, configuration, and/or type (each being of an at least generally elongated configuration and sufficiently flexible so as to be able to wrap around the associated main drum 38 or sand drum 70). The cable 20 is anchored to the main drum 38 and extends through a pulley assembly 24*a* on the derrick 18, while the wire line 22 is anchored to the sand drum 70 and extends through a pulley assembly 24*b* on the derrick 18. The pulley assemblies 24*a*, 24*b* are only schematically illustrated in FIG. 1. Each of the pulley assembly 24*a* and the pulley assembly 24*b* may include one or more pulleys, one or more block and tackles, or both, and each component of each pulley assembly 24*a*, 24*b* which may be disposed at one or more locations on the derrick 18 and further disposed in any appropriate arrangement.

A component 28*a* is schematically illustrated in FIG. 1 as being suspended from the cable 20 "downstream" of the associated pulley assembly 24*a*, while a component 28*b* is schematically illustrated in FIG. 1 as being suspended from the wire line 22 "downstream" of the associated pulley assembly 24*b*. Typically, only one of the cable 20 and wire line 22 will be used at any one time (i.e., the other will be appropriately secured out of the way, for instance "tied" to the derrick 18). Each of the components 28*a*, 28*b* may be of any appropriate size, shape, configuration, and/or type. The component 28*a* will typically be one that is used by the well that is being serviced by the workover rig 10, while the component 28*a* will typically be a test instrument or the like that is directed into the well hole during servicing of the well.

The drawworks 30 is used to raise and lower the component 28*a* via the cable 20 and rotation of the main drum 38, while the drawworks 30 is used to raise and lower the component 28*b* via the wire line 22 and rotation of the sand drum 70. In this regard and for the illustrated embodiment, an engine 14 (only schematically illustrated) of the vehicle 12 is also used to operate a right angle drive 16 (only schematically illustrated), which in turn is used to power the drawworks 30 (e.g., to rotate the sand drum 70, and which may also then rotate the main drum 38).

Figure 2:
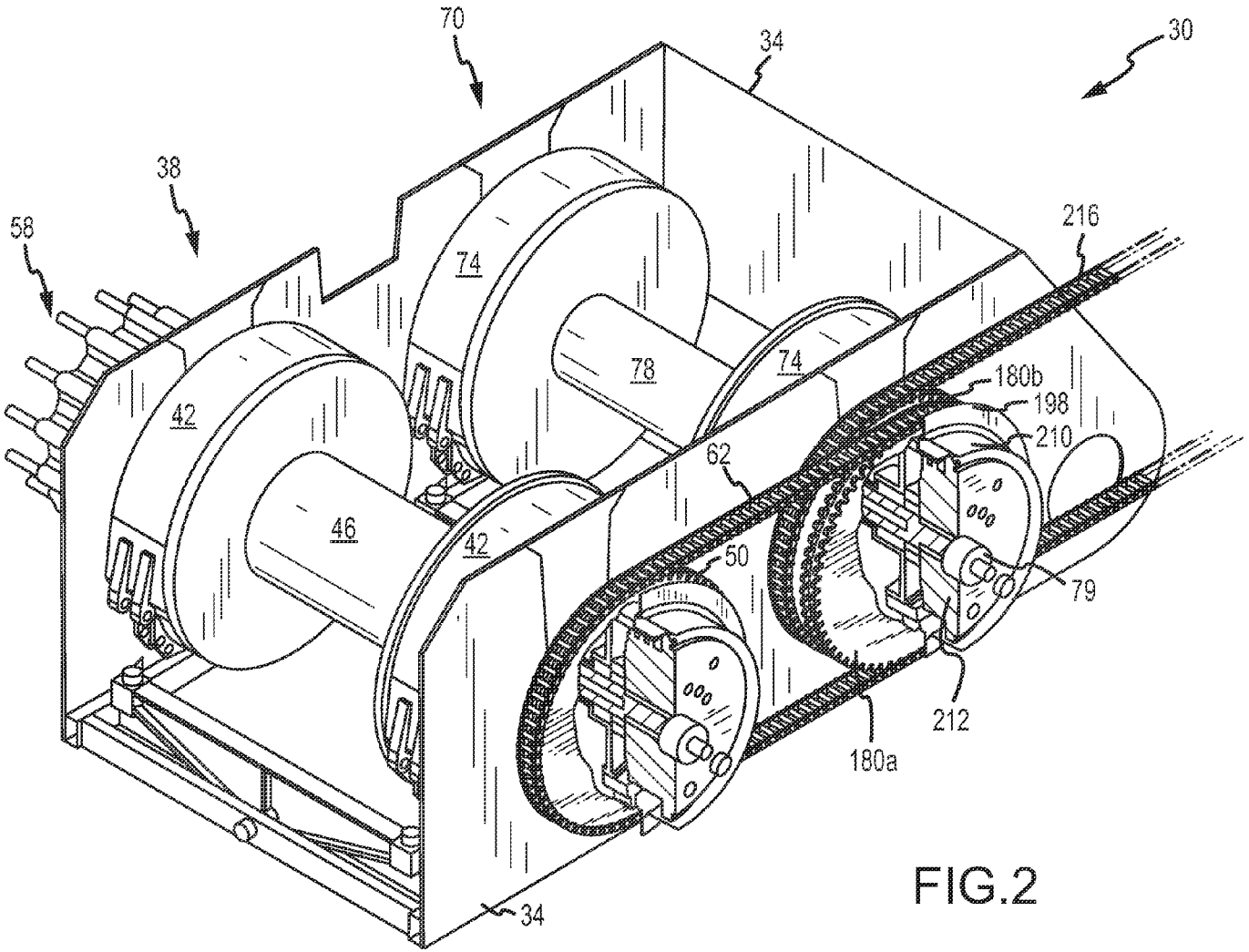
FIG. 2 is a perspective view of one embodiment of a drawworks for a workover rig.
Figure 3:
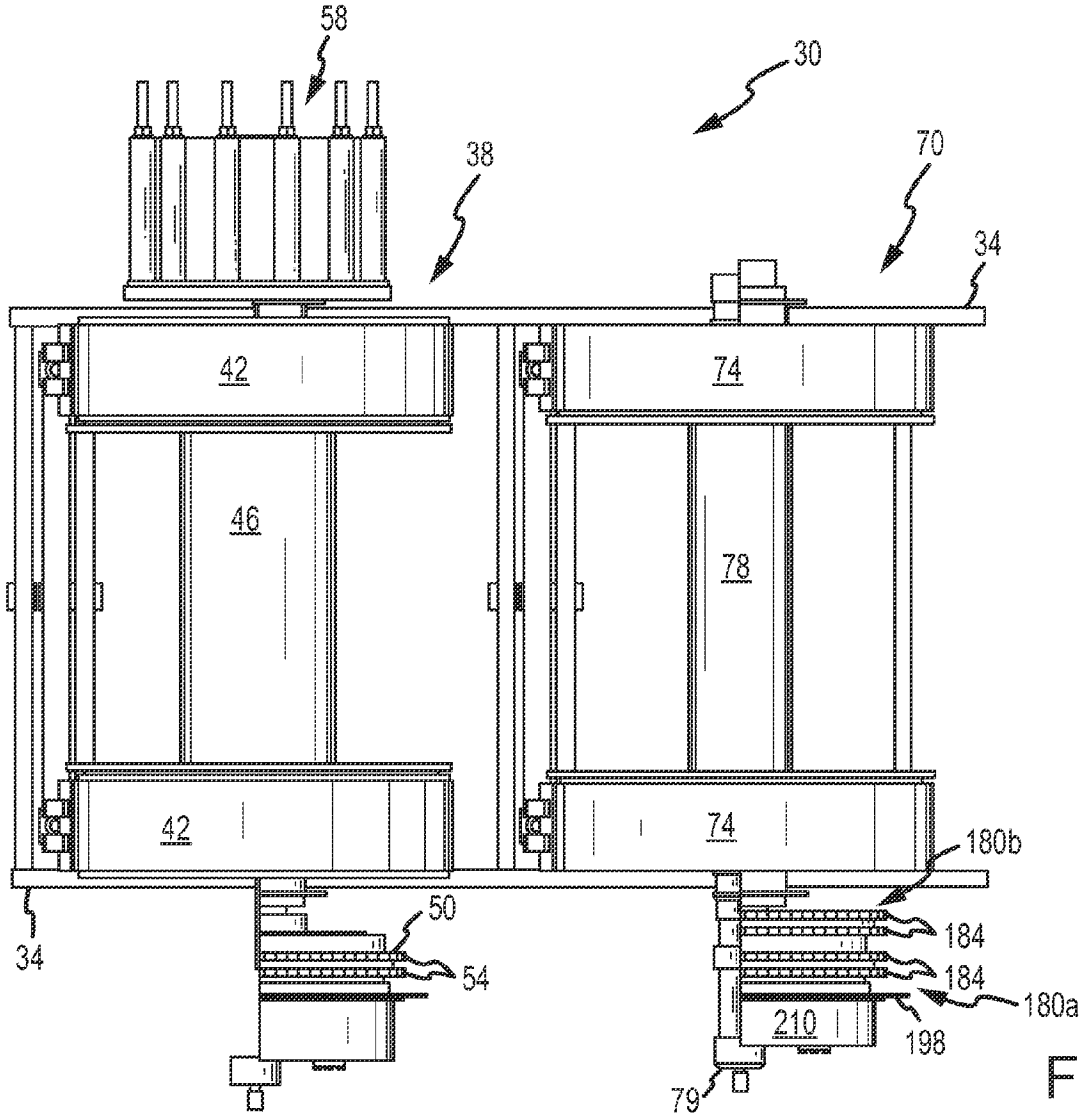
FIG. 3 is a top view of the drawworks of FIG. 2.
Figure 4A:
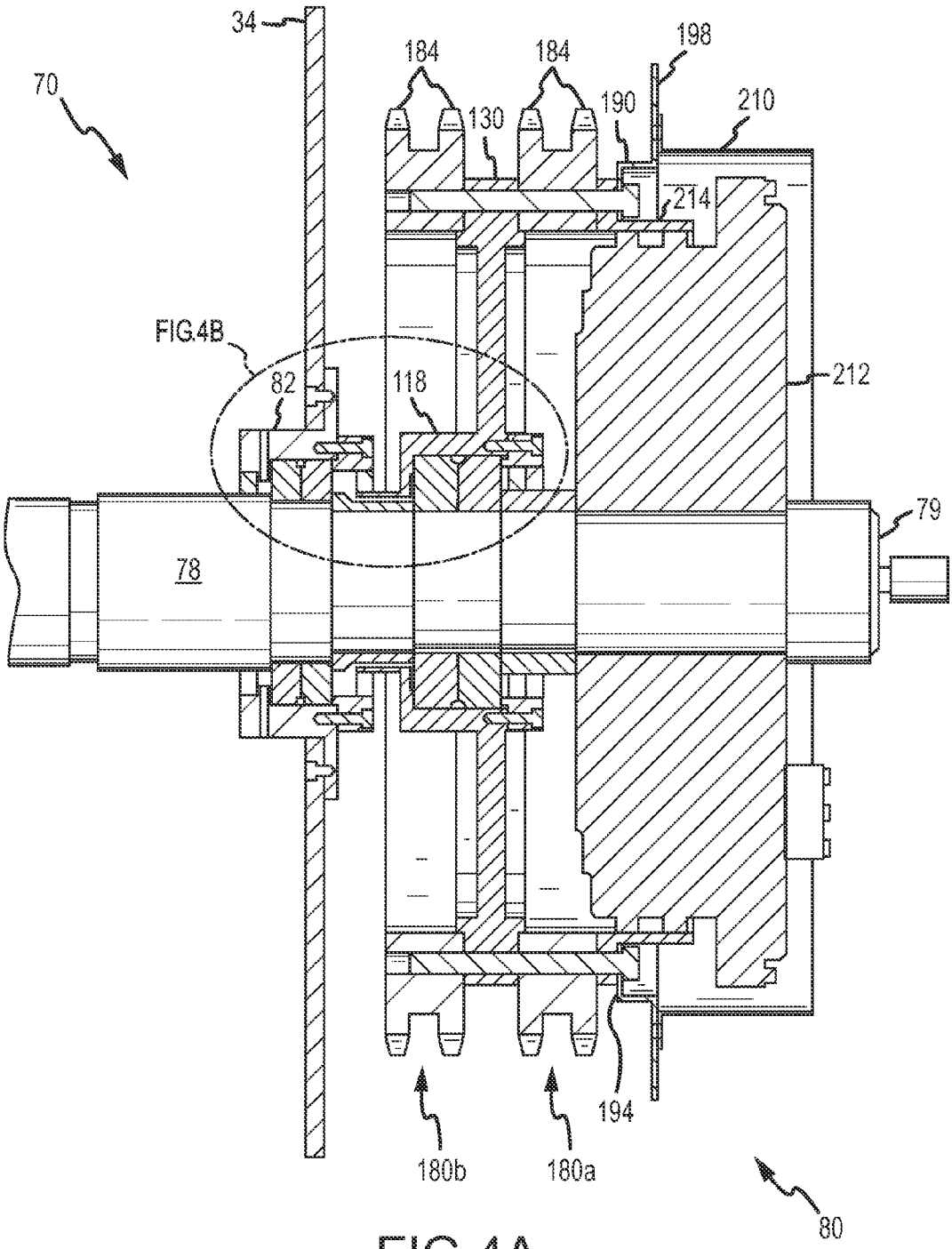
FIG. 4A is a cross-sectional view of part of a sand drum for the drawworks of FIG. 2, taken along the length dimension of the sand drum shaft.
Figure 4B:
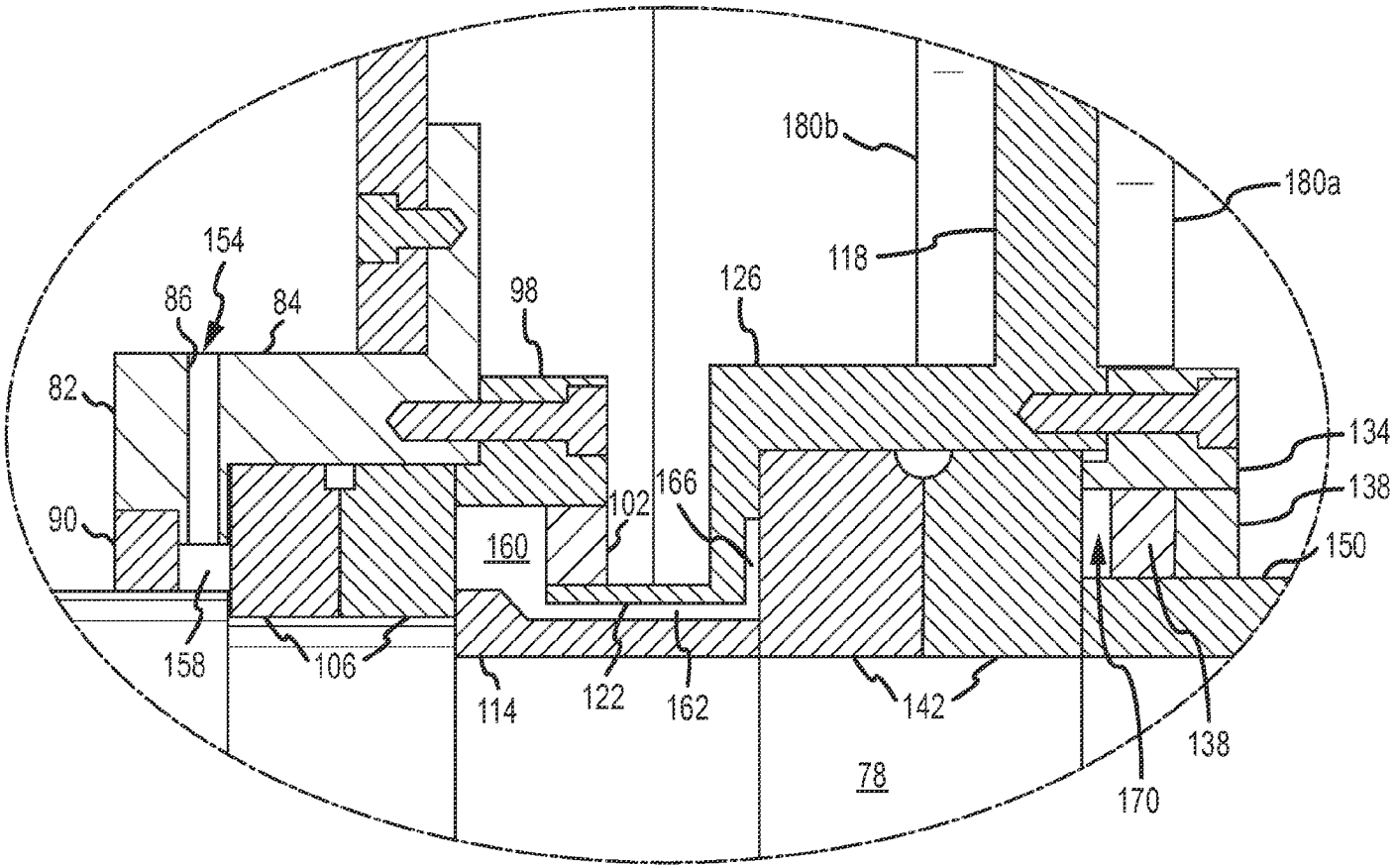
FIG. 4B is an enlargement of the region noted in FIG. 4A.
Figure 5:
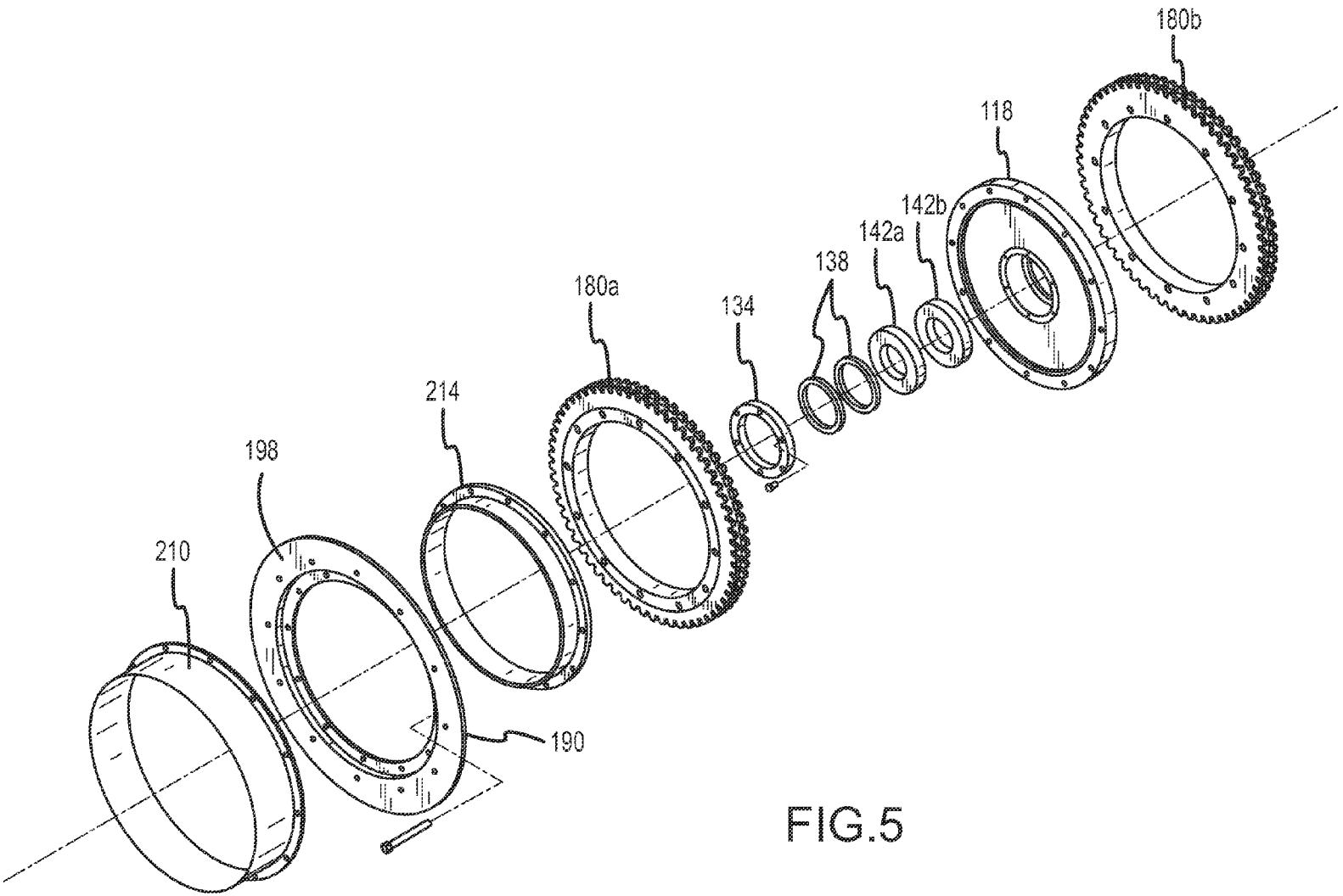
FIG. 5 is an exploded, perspective view of a drive hub of the sand drum of FIG. 4A, along with various other components of the sand drum that rotate along with the drive hub.
Figure 6:
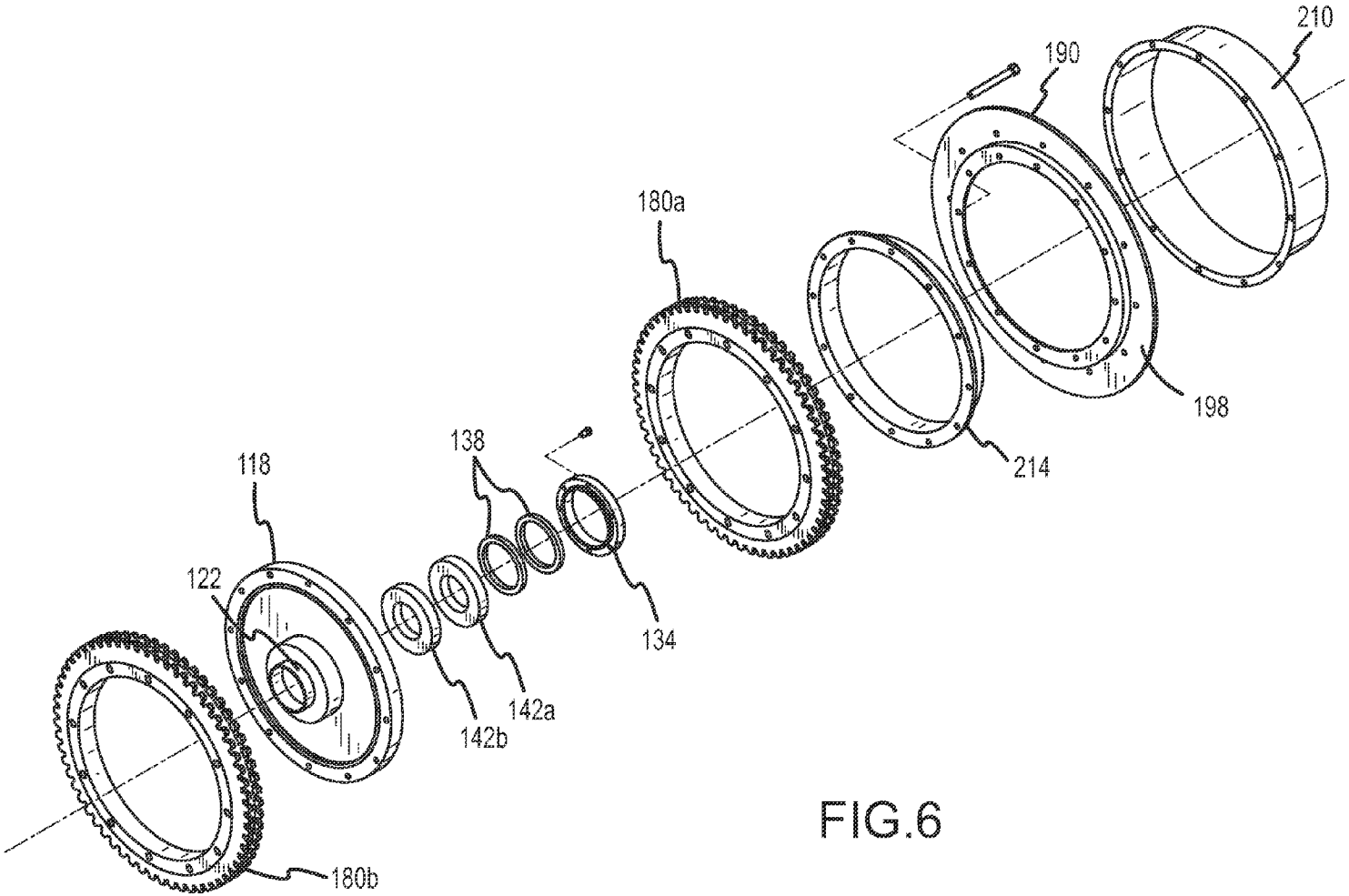
FIG. 6 is another exploded, perspective view of the same components from FIG. 5, but viewed from the opposite direction.
Figure 7:
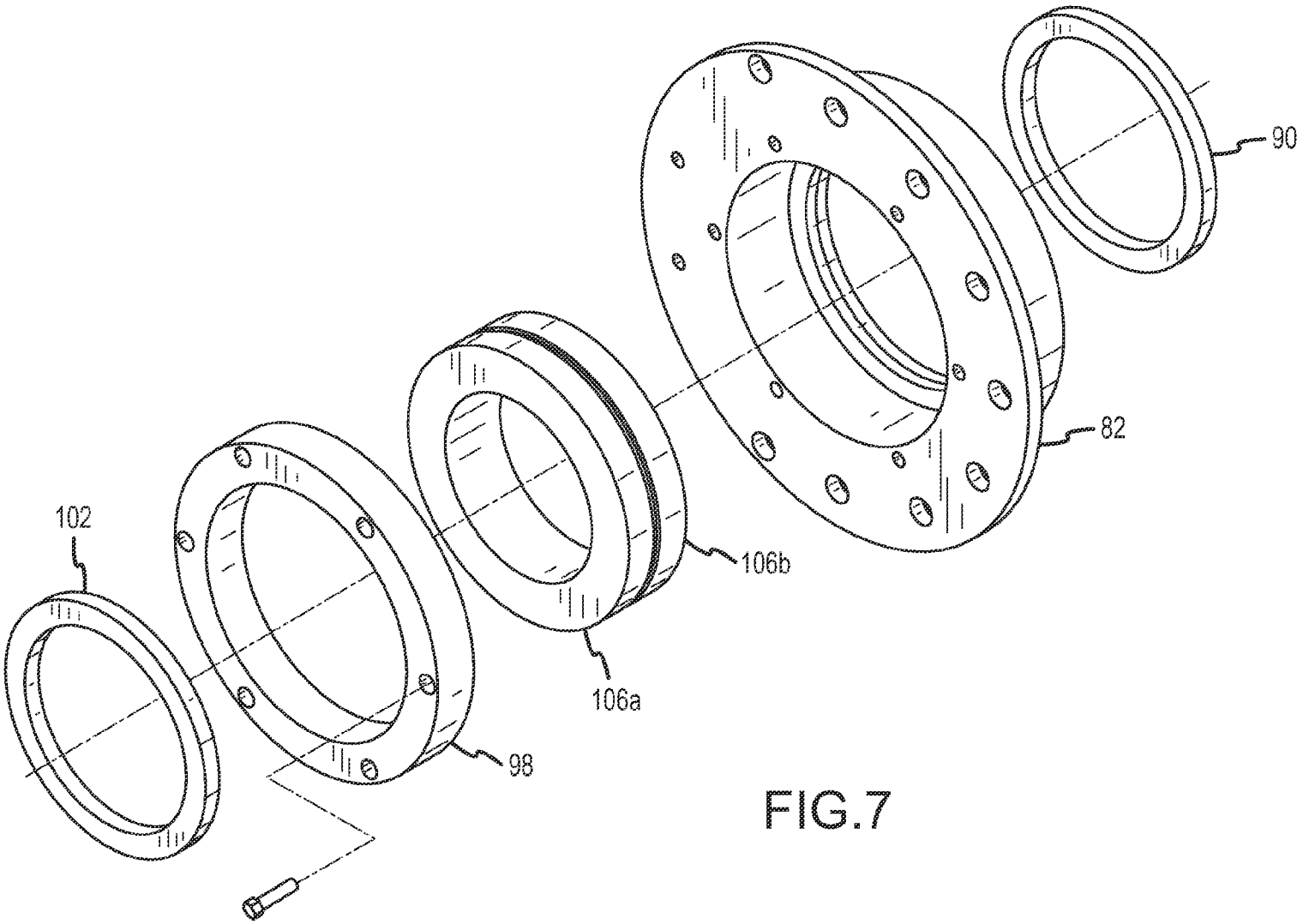
FIG. 7 is an exploded, perspective view of a winch wall bearing hub of the sand drum of FIG. 4A, along with various other adjacently disposed components.

FIGS. 2-3 present two views of the drawworks 30 used by the workover rig 10 of FIG. 1, and which may be adapted for use by a drilling rig as well. Therefore, the drawworks 30 may be referred to herein as a "rig drawworks 30." The drawworks 30 generally includes a main drum 38 and a sand drum 70 that are at least substantially contained within a winch wall 34 that extends about the main drum 38 and sand drum 70. The main drum 38 includes a pair of drum heads 42 that are spaced along a main drum shaft 46, and which may be rotated to wrap/unwrap cable or the like around the main drum shaft 46 between the spaced drum heads 42 (the main drum shaft 46 and drum heads 42 collectively rotate/move as a unit). A drive sprocket 50 of the main drum 38 is driven by a chain 62 from the sand drum 70 to rotate the main drum shaft 46 of the main drum 38. This drive sprocket 50 may include a pair of annular gear teeth sets 54, and may be of an integral or one-piece construction (e.g., having no joints between any adjacent pair of regions). A brake 58 is provided for terminating rotation of the main drum shaft 46 of the main drum 38 as desired/required, or to otherwise maintain the main drum shaft 46 in a fixed or stationary position.

The sand drum 70 similarly includes a pair of drum heads 74 that are spaced along a sand drum shaft 78, and which may be rotated to wrap/unwrap wire line or the like around the sand drum shaft 78 between the spaced drum heads 74 (the sand drum shaft 78 and drum heads 74 collectively rotate/move as a unit). The sand drum 70 includes a pair of drive sprockets 180*a*, 180*b* that are each disposed about the sand drum shaft 78 of the sand drum 70, that each include a pair of annular gear teeth sets 184, that may collectively rotate relative to the sand drum shaft 78 of the sand drum 70, and that also may selectively and collectively rotate the sand drum shaft 78 of the sand drum 70. The drive sprocket 180*a* of the sand drum 70 rotates the drive sprocket 50 of the main drum 38 via the noted chain 62. The drive sprocket 180*b* is rotated by an appropriate power source (e.g., a right angle drive) via a chain 216. The drive sprockets 180*a*, 180 of the sand drum 70 simultaneously rotate whenever being driven by the chain 216, while the sand drum shaft 78 of the sand drum 70 only rotates when a clutch 212 of the sand drum 70 (only schematically depicted) is engaged so that the sand drum shaft 78 rotates along with the drive sprockets 180*a*, 180*b*.

FIGS. 4A, 4B, and 5-7 illustrate various components associated with what may be characterized as a drive assembly 80 for the sand drum 70 of the drawworks 30 of FIGS. 2-3, and which is located toward a free end 79 of the sand drum shaft 78. This same drive assembly 80 may be used by the main drum 38 of the drawworks 30. Although the drive assembly 80 for the main drum 38 could be made more robust than the drive assembly 80 for the sand drum 70 based upon the higher loads to which it would be exposed during operation, preferably all components of the drive assembly 80 for the sand drum 70 are interchangeable with the corresponding components of the drive assembly 80 for the main drum 38. However and as discussed above, the main drum 38 uses a single drive sprocket 50, whereas the sand drum 70 uses a pair of drive sprockets 180*a*, 180*b* (the drive sprocket 50 of the main drum 38 would correspond with the drive sprocket 180*a* of the sand drum 70, when the drive assembly 80 is used by the main drum 38 such that the sprocket 180*b* of the sand drum 70 would not be used by the main drum 38). It should also be appreciated that the drive assembly 80 may also be used by a main drum for a drawworks of a drilling rig (not shown).

The drive assembly 80 includes a winch wall bearing hub 82 that is disposed about the sand drum shaft 78, and that is appropriately interconnected with the winch wall 34. Therefore, the winch wall bearing hub 82 is maintained in a stationary position. A lubricant port 86 extends from an exterior surface 84 of the winch wall bearing hub 82 and in the direction of the sand drum shaft 78 (the lubricant port 86 being at a location that is inside the wind wall 34), where the lubricant port 86 communicates with a lubricant cavity 158 that is disposed about the sand drum shaft 78 and that is preferably annular ("annular" means any configuration that extends a full 360° about the sand drum shaft 78, and thereby includes but is not limited to a circular configuration). The lubricant port 86 may be appropriately interconnected with a lubricant manifold (not shown) to allow an appropriate lubricant to be introduced at a single location and then directed to various different locations of the drawworks 30, including the lubricant port 86, or an individual zirc (not shown) could be mounted on the winch wall bearing hub 82 in communication with the lubricant port 86.

One or more annular seals 90 are disposed between the winch wall bearing hub 82 and the sand drum shaft 78 to retain lubricant within the lubricant flowpath 154 (e.g., to direct lubricant flowing through the lubricant port 86 into the lubricant cavity 158). The lubricant port 86 and lubricant cavity 158 are each part of what may be characterized as a lubricant flowpath 154. As will be discussed in more detail below, this lubricant flowpath 154 also includes one or more self-aligning bearings 106, a lubricant cavity 160 that is preferably annular about the sand drum shaft 78, an annular first lubricant flowpath section 162, a lubricant cavity 166 that is preferably annular, one or more ball bearings 142, and a lubricant cavity 170 that is also preferably annular.

A pair of self-aligning bearings 106 are disposed between the winch wall bearing hub 82 and the sand drum shaft 78, and are also disposed about the sand drum shaft 78. The self-aligning bearings 106 are at least generally disposed in end-to-end or back-to-back relation. Any appropriate number of self-aligning bearings could be utilized. A number of characterizations may be made in relation to the position of the self-aligning bearings 106. One is that the self-aligning bearings 106 are disposed between the lubricant port 86 and the adjacentmost free end 79 of the sand drum shaft 78 in a longitudinal dimension, where this longitudinal dimension coincides with a rotational axis of the sand drum shaft 78. Another characterization of the position of the self-aligning bearings 106 is that the self-aligning bearings 106 are disposed at a location that is downstream of both the lubricant port 86 and the lubricant cavity 158. "Downstream" corresponds with a general direction in which a lubricant flows through the lubricant flowpath 154 during a lubrication of the various bearings that are in this lubricant flowpath 154. Yet another characterization of the position of the self-aligning bearings 106 is that the self-aligning bearings 106 are disposed at a location that is upstream of the annular first lubricant flowpath section 162, where "upstream" corresponds with a direction that is opposite of the general direction in which a lubricant flows through the lubricant flowpath 154 during a lubrication of the various bearings that are in this lubricant flowpath 154.

The drive assembly 80 also includes a sprocket drive hub 118 that is disposed about the sand drum shaft 78 of the sand drum 70. What may be characterized as a flange 130 of the drive hub 118 is sandwiched between the drive sprockets 180*a*, 180*b* of the sand drum 70, and is appropriately interconnected therewith (e.g., using one or more appropriate fasteners). Therefore, the drive hub 118 rotates along with the drive sprockets 180*a*, 180*b*.

The above-noted drive hub 118 also includes an annular first drive hub section 122 that is spaced from a sleeve 114 in a radial dimension (the radial dimension being orthogonal to the rotational axis of the sand drum shaft 78) to define the above-noted annular first lubricant flowpath section 162 of the lubricant flowpath 154, where this sleeve 114 is disposed about the sand drum shaft 78. In this regard, a seal flange 98 is appropriately interconnected with the winch wall bearing hub 82, and one or more annular seals 102 are disposed between this seal flange 98 and the annular first drive hub section 122 to retain lubricant within the lubricant flowpath 154. The annular first lubricant flowpath section 162 is disposed immediately downstream of the lubricant cavity 160, or stated another way the first lubricant flowpath section 162 is disposed between the lubricant cavity 160 and the adjacentmost free end 79 of the sand drum shaft 78 in the longitudinal dimension.

Another portion of the drive hub 118 may be characterized as an annular second drive hub section 126 that is disposed radially outwardly from a pair of ball bearings 142 (e.g., a double ball bearing configuration), and that is thereby also disposed about the sand drum shaft 78. These ball bearings 142 are at least generally disposed in end-to-end or back-to-back relation. Any appropriate number of ball bearings could be utilized. A number of characterizations may be made in relation to the position of the ball bearings 142. One is that the ball bearings 142 are disposed between the self-aligning bearing(s) 106 and the adjacentmost free end 79 of the sand drum shaft 78 in the noted longitudinal dimension. Another characterization of the position of the ball bearings 142 is that the ball bearings 142 are disposed at a location that is downstream of the annular first lubricant flowpath section 162. Yet another characterization of the position of the ball bearings 142 is that the ball bearings 142 are disposed between the annular first lubricant flowpath section 162 and the adjacentmost free end 79 of the sand drum shaft 78 in the noted longitudinal dimension.

The lubricant cavity 170 is disposed downstream of the ball bearings 142. Stated another way, the lubricant cavity 170 is disposed between the ball bearings 142 and the adjacentmost free end 79 of the sand drum shaft 78 for the sand drum 70 in the noted longitudinal dimension. In any case, a seal cover 134 is appropriately detachably interconnected and rotatable with the drive hub 118 (e.g., using one or more fasteners). Moreover, at least one annular seal 138 is disposed between the seal cover 134 and a sleeve 150 that is disposed about the sand drum shaft 78 for the sand drum 70. Preferably, at least two such annular seals 138 are utilized and as shown, with these seals 138 being disposed in end-to-end or back-to-back relation. The left-most seal 138 in the view presented in FIG. 4B may be viewed as keeping lubricant from flowing to the right, while the right-most seal 138 in the view presented in FIG. 4B may be viewed as reducing the potential that external contaminants will flow to the left past the seals 138 (e.g., to reduce the potential that these external contaminants will enter the lubricant flowpath 154). In the illustrated embodiment, the seals 90, 102, and 138 are of the same size, shape, configuration, and type so as to be completely interchangeable.

Based upon the foregoing, lubricant that is directed into the lubricant port 86 of the winch wall bearing hub 82 flows into the lubricant cavity 158, then through the self-aligning bearings 106, then into the lubricant cavity 160, then through the annular first lubricant flowpath section 162 (which again is defined by part of the drive hub 118 (specifically the first drive hub section 122) and the sleeve 114), then into the lubricant cavity 166, then through the ball bearings 142, and then possibly into the lubricant cavity 170. Preferably, each of the lubricant cavity 158, the lubricant cavity 160, the first lubricant flowpath section 162, and the lubricant cavity 166 are annular in that they extend completely about the entire perimeter of the sand drum shaft 78 for the sand drum 70. As such, a blockage of a portion of any of the first lubricant flowpath section 162 and cavities 158, 160, and 166 should not adversely affect the ability to get lubricant to the self-aligning bearings 106 and the ball bearings 142. Therefore, the drawworks 30 may be characterized as being configured to enhance the ability to adequately lubricate various of its components, and thereby should prolong the life expectancy of these components. In one embodiment, the lubricant cavity 166 is about ½ of the width of the lubricant cavity 160 in the view presented in FIG. 4A (where the width dimension coincides with the longitudinal dimension), and the lubricant cavity 166 and the lubricant cavity 170 or at least about substantially the same width. It may be desirable for a relief passageway to be interconnected with the lubricant cavity 170 for the case of an over-lubrication (not shown).

The configuration of the drive hub 118 provides lubricating advantages (e.g., by providing an annular, first lubricant flowpath section 162 that leads to the ball bearings 142, and that is defined by the first drive hub section 122 and the sleeve 114 as noted). Another advantage relating to the drive hub 118 is the manner in which it is integrated with the drive sprockets 180*b*, 180*a*. Generally, the drive hub 118, drive sprocket 180*b*, and drive sprocket 180*a* are detachably interconnected to define a common assembly. This is advantageous in a number of respects. One is that each of these parts may be separately replaced/refurbished. For instance, any need to scrap one of the drive sprocket 180*b*, the drive hub 118, or the drive sprocket 180*a* does not require the other two of these three parts to similarly be scrapped. Such is not the case with known drawworks designs. Another advantage of having separately formed and detachably interconnected drive sprockets 180*a*, 180*b* and a drive hub 188 is that a spare drive sprocket could be used on either the sand drum 70 (for either of the drive sprockets 180*a*, 180*b*) or on the main drum 38 (for the drive sprocket 50), and that a spare drive hub could be used on either the sand drum 70 or on the main drum 38.

The ability to replace a single sprocket 180*a*, 180*b*, or drive hub 118 without having to replace all three parts is advantageous as noted. Another advantage relating to the drive sprockets 180*a*, 180*b* is that each may be an integrally formed structure, with no joint between any adjacent pair of regions. This enhances the strength of each individual drive sprocket 180*a*, 180*b*, and should extend the life of each individual drive sprocket as well. As noted above, each drive sprocket 180*a*, 180*b* preferably includes a pair of annular gear teeth sets 184. Prior art configurations that have a dual set of teeth realize this configuration by welding two separate sprocket sections together.

Lubricant exists on the drive sprockets 180*a*, 180*b*, as well as on the corresponding chain 62, 216. This lubricant has a tendency to be propelled from the sprockets 180*a*, 180*b* and chains 62, 216 during rotation of the sprockets 180*a*, 180*b*. It is desirable to keep this lubricant from reaching the clutch 212. At least some prior art drawworks used a stationary cover that was disposed over the clutch. In contrast, the drive assembly 80 uses both an oil slinger 190 and clutch cover 210, each of which rotate along with the drive sprockets 180*a*, 180*b* and drive hub 118.

The oil slinger 190 includes a mounting flange 194 and what may be characterized as an oil slinging section 198. A portion of a clutch drive ring 214 is retained between the mounting flange 194 of the oil slinger 190 and the drive sprocket 180*a*. The oil slinger 190, clutch drive ring 214, drive sprocket 180*a*, drive hub 118, and drive sprocket 180*b* are detachably maintained together by one or more fasteners of any appropriate size, shape, configuration, and/or type (e.g., a plurality of fasteners each may extend through each of the oil slinger 190, clutch drive ring 214, drive sprocket 180*a*, drive hub 118, and through/into the drive sprocket 180*b*). As such, the oil slinger 190, clutch drive ring 214, drive sprocket 184, drive hub 118, and drive sprocket 180*b* collectively rotate together. The clutch 212 may move into engagement with the clutch drive ring 214 (e.g., via a splined connection or the like) to rotate the clutch 212, which in turn rotates the sand drum shaft 78 along with the drive sprockets 180*a*, 180, and the clutch 212 may also move out of engagement with the clutch drive ring 214 (e.g., via a splined connection or the like) to allow the drive sprockets 180*a*, 180*b* to rotate relative to a now stationary clutch 212 and sand drum shaft 78.

The oil slinging section 198 of the above-noted oil slinger 190 extends at least generally away from the sand drum shaft 78, and is disposed between the clutch 212 and the sprockets 180*a*, 180*b* (and their corresponding chains 62, 216) in the longitudinal dimension. Preferably, the oil slinging section 198 extends to a position in the radial dimension (again, where the radial dimension is a dimension that is orthogonal to a rotational axis of the sand drum shaft 78) that is beyond a location of a perimeter of each of the drive sprockets 180*a*, 180*b* in the radial dimension (and at least to a position in the radial dimension that corresponds with the position of the chains 62, 216 in the radial dimension as well). Stated another way, the perimeter of the oil slinging section 198 is disposed at least as far from the shaft 78 as each of the sprockets 180*a*, 180*b*, and chains 62, 216. In the illustrated embodiment, the oil slinging section 198 is disposed at least generally orthogonally to the rotational axis of the sand drum shaft 78, although other orientations may be appropriate. Lubricant from the drive sprockets 180*a*, 180*b* or chains 62, 216 that impacts the oil slinging section 198 should be directed radially away from the clutch 212, thereby reducing the potential that this lubricant will adversely affect the performance of the clutch 212.

The clutch cover 210 is appropriately interconnected with the oil slinger 190, so as to rotate therewith as noted. In the illustrated embodiment, a flange of the clutch cover 210 is disposed in interfacing relation with a radially inward portion of the oil slinging section 198, and is interconnected therewith by a plurality of appropriate fasteners.

In summary, the drawworks 30 provides a number of advantages over known designs. One is that the lubricant flowpath 154 should be less prone to blockage (e.g., due to a "waxing" of lubricant) based upon at least the first lubricant flowpath section 162 being annular, and preferably with each portion of the lubricant flowpath 154 that extends along the shaft 78 and that is located "outside" of the various bearings being of an annular configuration. The various components of the drive assembly 80 may be used in both the main drum 38 and the sand drum 70 as desired/required (e.g., a given drive sprocket or drive hub may be used on both the main drum 38 and the sand drum 70). Another is the detachable nature of the drive hub 118 in relation to each associated drive sprocket (e.g., drive sprockets 180*a*, 180*b* in the case of the sand drum 70; drive sprocket 50 in the case of the main drum 38). Moreover, the individual drive sprockets 50, 180*a*, and 180*b* may be of a more robust, one-piece or integral construction. Finally, the drive assembly 80 reduces the potential for lubricant adversely affecting the performance of the clutch 212 (e.g., via the oil slinger 190 and/or the clutch cover 210, each of which rotate along with the corresponding drive sprocket(s)).

The foregoing description of the present invention has been presented for purposes of illustration and description. Furthermore, the description is not intended to limit the invention to the form disclosed herein. Consequently, variations and modifications commensurate with the above teachings, and skill and knowledge of the relevant art, are within the scope of the present invention. The embodiments described hereinabove are further intended to explain best modes known of practicing the invention and to enable others skilled in the art to utilize the invention in such, or other embodiments and with various modifications required by the particular application(s) or use(s) of the present invention. It is intended that the appended claims be construed to include alternative embodiments to the extent permitted by the prior art.

What is claimed is:

1. A rig drawworks comprising a first drum, wherein said first drum comprises:

a rotatable first drum shaft having a rotational axis that extends in a longitudinal dimension;

first and second drum heads spaced along said first drum shaft to accommodate a wrapping of a rig line about said first drum shaft between said first and second drum heads;

a drive hub disposed about, rotatable relative to, and selectively rotatable with said first drum shaft;

a first drive hub bearing between said drive hub and said first drum shaft; and a lubricant flowpath, wherein said lubricant flowpath comprises said first drive hub bearing and a first lubricant flowpath section that is annular about said first drum shaft, wherein said lubricant flowpath further comprises an inlet where a lubricant may be introduced into said lubricant flowpath and which will flow through said first lubricant flowpath section and then to said first drive hub bearing.

2. The rig drawworks of claim 1, wherein said first drive hub bearing is located downstream of said first lubricant flowpath section in relation to a flow of lubricant through said lubricant flowpath during a lubrication of at least said first drive hub bearing.

3. The rig drawworks of claim 2, further comprising a first bearing and a bearing housing, wherein said first bearing is disposed about said first drum shaft within said bearing housing, wherein said bearing housing is spaced from said drive hub along said first drum shaft, and wherein said lubricant flowpath further comprises said first bearing.

4. The rig drawworks of claim 3, wherein said first bearing is located upstream of said first lubricant flowpath section in relation to a flow of lubricant through said lubricant flowpath during a lubrication of at least said first bearing and said first drive hub bearing.

5. The rig drawworks of claim 3, wherein said inlet to said lubricant flowpath comprises a port, wherein an exterior surface of said bearing housing comprises said port, and wherein part of said lubricant flowpath extends from said port, through said bearing housing, and to said first bearing.

6. The rig drawworks of claim 2, further comprising a second drive hub bearing, wherein said lubricant flowpath further comprises said second drive hub bearing, and wherein said second drive hub bearing is adjacent to said first drive hub bearing and is downstream of said first drive hub bearing in relation to a flow of lubricant through said lubricant flowpath during a lubrication of at least said first and second drive hub bearings.

7. The rig drawworks of claim 6, wherein said lubricant flowpath further comprises an annular lubricant cavity, and wherein said annular lubricant cavity is downstream of said second drive hub bearing in relation to a flow of lubricant through said lubricant flowpath during a lubrication of at least said first and second drive hub bearings.

8. The rig drawworks of claim 2, wherein said lubricant flowpath further comprises an annular lubricant cavity, and wherein said annular lubricant cavity is downstream of said first drive hub bearing in relation to a flow of lubricant through said lubricant flowpath during a lubrication of at least said first drive hub bearing.

9. The rig drawworks of claim 8, further comprising a first annular seal, wherein said annular lubricant cavity is located between said first annular seal and said first drive hub bearing in said longitudinal dimension.

10. The rig drawworks of claim 9, further comprising a second annular seal disposed adjacent to said first annular seal, wherein said first annular seal is located between said lubricant cavity and said second annular seal in said longitudinal dimension.

11. The rig drawworks of claim 1, wherein said drive hub comprises an annular first drive hub section, wherein said rig drawworks further comprises a sleeve disposed about said first drum shaft and disposed radially inwardly from said first drive hub section, and wherein said first lubricant flowpath section is located between said sleeve and said first drive hub section.

12. The rig drawworks of claim 11, wherein said drive hub further comprises an annular second drive hub section, and wherein said second drive hub section is disposed radially outwardly from said first drive hub bearing.

13. The rig drawworks of claim 11, further comprising first and second drive sprockets, wherein said drive hub further comprises a drive hub flange that is sandwiched between said first and second drive sprockets, and wherein said second drive sprocket is located between said drive hub flange and said first drive hub section in said longitudinal dimension.

14. The rig drawworks of claim 13, wherein said drive hub flange is detachably interconnected with each of said first drive sprocket and said second drive sprocket.

15. The rig drawworks of claim 13, wherein each of said first and second drive sprockets comprises a first gear teeth set that is disposed about said first drum shaft and a second gear teeth set that is also disposed about said first drum shaft at a location that is spaced from said first gear teeth set along said first drum shaft, and wherein each of said first and second drive sprockets are integral structures.

16. The rig drawworks of claim 13, further comprising an oil slinger interconnected with at least said first drive sprocket, wherein said oil slinger comprises an oil slinging section that extends at least generally radially outwardly relative to said first drum shaft to a location in a radial dimension that is beyond a location of a perimeter of said first drive sprocket in said radial dimension, and wherein said radial dimension is orthogonal to said rotational axis of said first drum shaft.

17. The rig drawworks of claim 16, wherein said oil slinger is detachably interconnected with at least said first drive sprocket.

18. The rig drawworks of claim 16, wherein said second drive sprocket, said drive hub flange, said first drive sprocket, and said oil slinger are detachably interconnected together so as to collectively rotate.

19. The rig drawworks of claim 11, further comprising a first drive sprocket, wherein said drive hub further comprises a drive hub flange that is located between said first drive sprocket and said first drive hub section in said longitudinal dimension.

20. The rig drawworks of claim 19, wherein said drive hub flange is detachably interconnected with said first drive sprocket.

21. The rig drawworks of claim 19, wherein said first drive sprocket comprises a first gear teeth set that is disposed about said first drum shaft and a second gear teeth set that is also disposed about said first drum shaft at a location that is spaced from said first gear teeth set along said first drum shaft, and wherein said first drive sprocket is an integral structure.

22. The rig drawworks of claim 19, further comprising an oil slinger interconnected with said first drive sprocket, wherein said oil slinger comprises an oil slinging section that extends at least generally radially outwardly relative to said first drum shaft to a location in a radial dimension that is beyond a location of a perimeter of said first drive sprocket in said radial dimension, wherein said radial dimension is orthogonal to said rotational axis of said first drum shaft, and wherein said first drive sprocket is located between said drive hub flange and said oil slinging section in said longitudinal dimension.

23. The rig drawworks of claim 22, wherein said oil slinger is detachably interconnected with at least said first drive sprocket.

24. The rig drawworks of claim 22, wherein said drive hub flange, said first drive sprocket, and said oil slinger are detachably interconnected together so as to collectively rotate.

25. The rig drawworks of claim 1, further comprising first and second drive sprockets, wherein said drive hub further comprises a drive hub flange that is sandwiched between said first and second drive sprockets, and wherein said second drive sprocket is located between said drive hub flange and said first lubricant flowpath section in said longitudinal dimension.

26. The rig drawworks of claim 25, wherein said drive hub flange is detachably interconnected with each of said first drive sprocket and said second drive sprocket.

27. The rig drawworks of claim 25, wherein each of said first and second drive sprockets comprises a first gear teeth set that is disposed about said first drum shaft and a second gear teeth set that is also disposed about said first drum shaft at a location that is spaced from said first gear teeth set along said first drum shaft, and wherein each of said first and second drive sprockets are integral structures.

28. The rig drawworks of claim 25, further comprising an oil slinger interconnected with said first drive sprocket, wherein said oil slinger comprises an oil slinging section that extends at least generally radially outwardly relative to said first drum shaft to a location in a radial dimension that is beyond a location of a perimeter of said first and second drive sprockets in said radial dimension, wherein said radial dimension is orthogonal to said rotational axis of said first drum shaft, and wherein second drive sprocket is located between said drive hub flange and said oil slinging section in said longitudinal dimension.

29. The rig drawworks of claim 28, wherein said oil slinger is detachably interconnected with at least said first drive sprocket.

30. The rig drawworks of claim 28, wherein said drive hub flange, said first and second drive sprockets, and said oil slinger are detachably interconnected together so as to collectively rotate.

31. The rig drawworks of claim 1, further comprising a first drive sprocket, wherein said drive hub further comprises a drive hub flange that is located between said first drive sprocket and said first lubricant flowpath section in said longitudinal dimension.

32. The rig drawworks of claim 31, wherein said drive hub flange is detachably interconnected with said first drive sprocket.

33. The rig drawworks of claim 31, wherein said first drive sprocket comprises a first gear teeth set that is disposed about said first drum shaft and a second gear teeth set that is also disposed about said first drum shaft at a location that is spaced from said first gear teeth set along said first drum shaft, and wherein said first drive sprocket is an integral structure.

34. The rig drawworks of claim 31, further comprising an oil slinger interconnected with said first drive sprocket, wherein said oil slinger comprises an oil slinging section that extends at least generally radially outwardly relative to said first drum shaft to a location in a radial dimension that is beyond a location of a perimeter of said first drive sprocket in said radial dimension, wherein said radial dimension is orthogonal to said rotational axis of said first drum shaft, and wherein said first drive sprocket is located between said drive hub flange and said oil slinging section in said longitudinal dimension.

35. The rig drawworks of claim 34, wherein said oil slinger is detachably interconnected with at least said first drive sprocket.

36. The rig drawworks of claim 34, wherein said drive hub flange, said first drive sprocket, and said oil slinger are detachably interconnected together so as to collectively rotate.

37. A rig comprising the rig drawworks of claim 1, wherein said rig is selected from the group consisting of a drilling rig and a service rig.

38. The rig of claim 37, further comprising:

a first drive sprocket disposed about, rotatable relative to, and selectively rotatable with said first drum shaft; and an oil slinger interconnected with at least said first drive sprocket, wherein said oil slinger comprises an oil slinging section that extends at least generally radially outwardly relative to said first drum shaft to a location in a radial dimension that is beyond a location of a perimeter of said first drive sprocket in said radial dimension, and wherein said radial dimension is orthogonal to said rotational axis of said first drum shaft.

39. The rig of claim 38, wherein said oil slinger is detachably interconnected with at least said first drive sprocket.

40. The rig drawworks of claim 1, wherein said inlet comprises a lubricant port located on an exterior surface of said rig drawworks.

41. A rig drawworks comprising a first drum, wherein said first drum comprises:

a rotatable first drum shaft having a rotational axis that extends in a longitudinal dimension;

first and second drum heads spaced along said first drum shaft to accommodate a wrapping of a rig line about said first drum shaft between said first and second drum heads;

a first drive sprocket disposed about, rotatable relative to, and selectively rotatable with said first drum shaft; and an oil slinger that is interconnected and rotatable along with said first drive sprocket, wherein said oil slinger comprises an oil slinging section that extends at least generally radially outwardly relative to said first drum shaft to a location in a radial dimension that is beyond a location of a perimeter of said first drive sprocket in said radial dimension, and wherein said radial dimension is is orthogonal to said rotational axis of said first drum shaft.

42. The rig drawworks of claim 41, wherein said first drive sprocket comprises a first gear teeth set that is disposed about said first drum shaft and a second gear teeth set that is also disposed about said first drum shaft at a location that is spaced from said first gear teeth set along said first drum shaft, and wherein said first drive sprocket is an integral structure.

43. The rig drawworks of claim 41, further comprising:

a drive hub disposed about, rotatable relative to, and selectively rotatable with said first drum shaft.

44. The rig drawworks of claim 43, wherein said drive hub is detachably interconnected with said first drive sprocket.

45. The rig drawworks of claim 41, further comprising:

a second drive sprocket, wherein said drive hub comprises a drive hub flange, wherein said drive hub flange is disposed between said first and second drive sprockets, and wherein said drive hub is detachably interconnected with each of said first and second drive sprockets such that said drive hub and said first and second drive sprockets are able to rotate collectively.

46. The rig drawworks of claim 45, wherein said oil slinger is detachably interconnected with said first drive sprocket.

47. The rig drawworks of claim 41, wherein said oil slinger is detachably interconnected with said first drive sprocket.

48. A rig comprising the rig drawworks of claim 41, wherein said rig is selected from the group consisting of a drilling rig and a service rig.

49. The rig drawworks of claim 41, further comprising:

a drive hub disposed about, rotatable relative to, and selectively rotatable with said first drum shaft, wherein said drive hub is interconnected with said first drive sprocket;

a first drive hub bearing between said drive hub and said first drum shaft; and a lubricant flowpath, wherein said lubricant flowpath comprises said first drive hub bearing and a first lubricant flowpath section that is annular about said first drum shaft.

50. A rig drawworks comprising a first drum, wherein said first drum comprises:

a rotatable first drum shaft having a rotational axis that extends in a longitudinal dimension;

first and second drum heads spaced along said first drum shaft to accommodate a wrapping of a rig line about said first drum shaft between said first and second drum heads;

a drive hub disposed about, rotatable relative to, and selectively rotatable with said first drum shaft;

a first drive hub bearing between said drive hub and said first drum shaft;

a lubricant flowpath, wherein said lubricant flowpath comprises said first drive hub bearing and a first lubricant flowpath section that is annular about said first drum shaft;

a first drive sprocket disposed about, rotatable relative to, and selectively rotatable with said first drum shaft;

a clutch engageable with said first drive sprocket such that said first drive sprocket and clutch collectively rotate; and an oil slinger that is interconnected and rotatable along with said first drive sprocket, wherein lubricant that is propelled from said first drive sprocket and that contacts said oil slinger is directed away from said clutch.

* * * * *